United States Patent [19]

Aitken et al.

[11] Patent Number: 5,046,567

[45] Date of Patent: Sep. 10, 1991

[54] ADIABATICALLY INDUCED IGNITION OF COMBUSTIBLE MATERIALS

[75] Inventors: John Aitken, Houston, Tex.; Victorio L. Oria, Pilar BsAs, Argentina

[73] Assignees: Mecano-Tech, Inc., Tex.; Explosivos Tecnologios Argentino S.A., Argentina

[21] Appl. No.: 435,061

[22] Filed: Nov. 13, 1989

[51] Int. Cl.[5] ..... E21B 43/1185; E21B 43/263; F42D 1/04; F42D 3/00

[52] U.S. Cl. ..... 175/4.6; 102/200; 102/205; 166/63; 166/299

[58] Field of Search ..... 166/299, 63, 297; 175/67, 2, 4.54, 4.6; 102/DIG. 702, 200, 205; 123/27 R, 27 GE, 68; 92/134; 89/7, 8; 299/13

[56] References Cited

U.S. PATENT DOCUMENTS

| | | | |
|---|---|---|---|
| 2,542,707 | 2/1951 | Ricardo et al. | 123/27 R |
| 2,947,221 | 8/1960 | Griffin et al. | 102/DIG. 702 X |
| 3,202,141 | 8/1965 | Lovell | 123/27 X |
| 3,602,309 | 8/1971 | Hill | 166/299 |
| 3,784,103 | 1/1974 | Cooley | 175/67 |
| 4,231,282 | 11/1980 | Ashley | 89/7 |
| 4,231,283 | 11/1980 | Malburg | 175/67 X |

*Primary Examiner*—Stephen J. Novosad
*Attorney, Agent, or Firm*—James L. Jackson

[57] ABSTRACT

A method and apparatus for achieving adiabatic heat ignition of combustible material, particularly explosive compositions which involves entrapping a quantity of gas in a chamber which is in communication with the combustible material and suddenly compressing the gas to the extent that the temperature thereof is increased adiabatically to the ignition temperature of the combustible material. The apparatus is particularly adaptable for use as an adiabatic ignition device for detonating cord and shaped charges of perforating guns for completion of wells. A quantity of high explosive within an explosive barrel is in detonating proximity with the detonating cord. A cylinder forms an air chamber which is in communication with the explosive composition and is provided with a piston for compression of the gas. One or more shear pins or other locking devices are provided to secure the piston in immovable relation with the cylinder. A force is caused to act on the piston which force is typically induced by fluid pressure within the well which acts on the piston and which may also be induced. As this force reaches a predetermined magnitude, or by means of a weight bar dropped or lowered on wireline from the surface, the piston will be released and the force will drive the piston into the cylinder, compressing the gas sufficiently to raise the temperature of the gas adiabatically to the ignition temperature of the explosive composition.

43 Claims, 3 Drawing Sheets

ADIABATICALLY INDUCED IGNITION OF COMBUSTIBLE MATERIALS

FIELD OF THE INVENTION

This invention broadly concerns a method and for adiabatic heat ignition of a wide variety of combustible materials. This invention relates generally to adiabatically induced ignition, inflaming and detonation of deflagration cartridges, gas generating charges and explosive compositions and which provide a safe and effective system for ignition or detonation thereof and which insures the safe handling of apparatus incorporating such materials prior to ignition or detonation and further insures safe handling of incorporating such materials in the event the materials fail to ignite or detonate. More particularly, the present invention relates to downhole perforating guns for perforating casing of well bores at production formation level and the provision of perforating guns having adiabatically induced detonation of an explosive device that initiates a detonating cord and shaped charges for accomplishing casing perforation activities.

BACKGROUND OF THE INVENTION

For purposes of simplicity this invention is discussed herein particularly as it relates to detonation of explosives in perforating guns for completing wells for production liquid and gaseous materials such as crude oil and natural gas from production formations in the earth. The invention, however, has many other applications within its spirit and scope.

In order to provide an explosive system that is quite safe to handle, it is desirable to eliminate the more sensitive and less reliable components of the explosive system.

Of the well perforating gun firing systems currently available, those employing electrical detonators may be accidentally discharged by stray currents from faulty power circuitry or grounding, radio frequency energy, electromagnetic transients or lightening strikes, all which are common hazards on drilling rigs.

Percussion or stab detonating devices utilize firing pin impact or friction on highly sensitive initiating material; and the firing pin must be prevented from restriking and possibly causing out of zone discharge from accidental jolts and jars in the event that the gun must be removed from the well unfired.

The system of this invention utilizes the abundance of hydrostatic energy typically available in deep well conditions to adiabatically stimulate a mass of gas to an intense heat to reliably initiate detonation of a perforating gun, thereby replacing conventional electrical, percussion, or stab blasting caps that are more vulnerable to accidental discharge during well perforating operations.

The hydraulic/adiabatic system hereof is inherently safe and reliable as it can not be fired at surface or down to a depth where sufficient hydrostatic potential exists. Unlike percussion or stab detonating means that require a metal to explosive friction or impact, only hot gases contact the initiating material and once the adiabatic heat has dissipated the gun may be retrieved from the well more safely whether it has fired or not.

A further and important feature of this invention is that, since the more highly sensitive compounds can be eliminated and the primary high explosive compounds can be detonated directly by means of adiabatically stimulated heat, the handling characteristics of the resulting explosive system is rendered more safe. Further, if the primary high explosive compounds can be eliminated and direct detonation of a secondary high explosive such as RDX can be stimulated adiabatically then the resulting explosive system will be even more safe.

Accordingly, it is a feature of this invention to achieve, by adiabatically induced heat, direct detonation of a secondary explosive composition to thus provide an explosive system that is inherently safe.

An explosive is a chemical composition that when ignited by heat, friction, impact or shock results in a sudden outburst of hot gas.

Explosives may be classified as deflagrating or detonating explosive depending on whether the velocity of decomposition is sub or supersonic. An arbitrary limit dividing deflagration and detonation is 900 meters per second.

Deflagrating or low explosives includes propellants, of which black gun powder is an example, which decompose rapidly with a high heat and pressure at subsonic velocity. As they burn no significant shock waves are produced Smokeless gun powder and ammonium perchlorate used in well bullet and core guns are other examples of powders in this category.

In detonating high explosives the chemical reaction takes place at supersonic velocity, principally within a thin detonation shock wave zone, traveling through the explosive in the order of 4500 to 7000 meters/second.

The detonating explosive category may be subdivided into, primary high explosives which detonate on exposure to relatively weak mechanical shock or flash, and while secondary high explosives are considerably less sensitive they usually require a detonator shock to induce high order detonation Examples of primary high explosives are: lead azide and lead styphnate used in detonators, while examples of the following secondary high explosives: PETN, RDX, HMX, HNS II, and PYX are of interest for well perforating guns employing shaped charges.

Whether the explosive decomposition path of an explosive is deflagration or detonation is dependent on the intensity of the initiating stimulation and confinement pressure as well as the nature of the particular explosive as for example black powder can be made to detonate.

The less sensitive but powerful secondary high explosives such as RDX used in well shaped charges and detonating cords traditionally require a detonator containing primary and secondary explosive to deliver the strong shock required to initiate them to high order.

Detonators used in well applications are of the electric, percussion or stab type according to the method of initiation. The adiabatic heat detonating device of this patent provides a new and safer method of detonating well perforating guns and other explosive or pyrotechnical devices.

Among the various compositions that are capable of being inflamed, ignited or detonated by adiabatically induced heat are the ignition compounds of a common electrical and non-electric blasting caps, deflagration compounds such as gun powder including the well known black powder, primary high order detonation compounds such as lead azide and secondary high order detonating compounds such as RDX. The initiating mixes of common detonators, often lower system temperature ratings AND are typically quite sensitive and therefore involve an element of danger when detonating caps using these compounds are employed in conjunction with powerful high explosive devices such as shaped charge perforating guns in deep oil well conditions. Likewise, primary high explosive compositions such as lead azide and lead styphnate are considered quite sensitive as heat or friction causes them to detonate high order, and thus are dangerous to handle, particularly in an oil well environment. The main body of the explosive charges consists of secondary high explosives, such as RDX, HMX, PYX, HNS, etc. which are extremely powerful but relatively insensitive to heat, shock, impact or friction, and can be handled quite safely but ordinarily require a primary high explosive device for detonation thereof. A typical combination of compounds for use as a high explosive initiating device would include a match compound for initial ignition in an electrical detonator or a friction sensitive compound in a non-electric percussion or a stab detonator that will in turn stimulate a primary detonating explosive compound such as lead azide which detonates and develops a shock wave of sufficient strength to achieve detonation of a secondary explosive such as RDX, etc.

Deflagration devices are often used as instantaneous power sources for developing a force that is utilized to do work. These devices incorporate deflagration compounds such as potassium perchlorate, strontium nitrate and sodium nitrate which, when ignited, inflame slowly relative to the deflagration of gun powder and develop a gas pressure which can be used as a pneumatic source for accomplishing work. For example, in downhole operations for completion of wells, plugs and packers may be set by power charges. Accordingly, it is a feature of this invention to provide a novel method by which power charges may be safely ignited by adiabatically induced ®d heat. It is also a feature of this invention to achieve adiabatic ignition of other combustible liquids or gases, for example, to release energy for doing any suitable work.

After wells have been drilled to the earth formation level of one or more production zones, the well bore intersecting these production zones is most often lined with pipe, typically referred to as well casing. The well casing is cemented in place within the well bore to thus establish a substantially integral relationship between the casing and the formation to thus provide a seal between the casing and the formation and to assure that the casing remains properly in place in the well bore for the extended life of the well being produced. After the casing has been installed, it is necessary to perforate the casing to thus establish communication between the well and the formation to be produced. These perforated intervals may be isolated by means of packers which establish a seal between the casing and production tubing that extends within the casing from the level of the production formation to the surface.

THE SHAPED CHARGE GUN

The shaped charge perforating gun, well known in the petroleum industry for perforating wells, is an outgrowth of secondary world war armor piercing weaponry. A shaped charge gun is comprised of three explosive elements, a blasting cap used to initiate a detonating cord that in turn initiates a number of individual shaped charges. Most often, the explosive elements are enclosed in a pressure tight carrier tube to protect and isolate them from well fluids.

Shaped charges and detonating cords utilize one of several relatively low sensitivity but powerful secondary high explosives such ar RDX, HMX, HNS or PYX. In secondary high explosives the chemical reaction takes place in a detonating shock wave traveling through the explosive in the order of 4500 to 7000 meterssecond.

The shaped charge itself consists of a quantity of secondary high explosive compressed into a charge case with a metallic lined hollow cavity at the end opposite from the point of initiation The hollow cavity may be parabolic or of more complex shapes but for the deep penetrating charges it is most commonly conical in form with a thin lining of copper or a mixture of compressed metallic powders. When a charge is initiated by the detonating cord at its axis of symmetry, a detonation shock wave propagates through the explosive typically at 6000 meters/second generating pressures of 300,000 atmospheres causing the metallic liner walls to collapse onto itself along the axis, projecting a portion of the liner material forward as a high speed penetrating jet traveling some 7000 meters/second.

The high speed jets impinge with pressures in the order of 500,000 atmospheres and thus easily perforate the well casing, cement and deep into the formation.

A significant variety of casing perforation devices have been developed over the years. One of the most practical and most acceptable types of casing perforation devices, typically referred to as perforating guns, are casing perforation tools having a plurality of shaped explosive charges which, when detonated, develop explosive jets which penetrate the steel wall of the casing and cement. The explosive jets also penetrate into the formation to thereby establish significant perforation passage surface area in the formation to stimulate production of hydrocarbon fluids such as crude oil, natural gas, distillate, etc.

One important type of well completion employing perforating guns is known as tubing-conveyed perforating or "TCP" completion.

A primary purpose of a TCP completion is to establish the best possible communication between the reservoir and the wellbore. This operation involves running large diameter, powerful guns on the production or working tubing string to form shaped charge perforations in cases over hundreds or thousands of feet of wellbore on a single t rip in the well. Inclusion of a production packer above the guns in the tubing string allows the desired underbalance pressure condition to be established between the formation and well so that when the charges are fixed simultaneously an immediate flow of production fluid into the wellbore from the perforations is established, thereby assuring a maximum number of clean, debris free perforations .

TCP guns are available with shot densities up to 12 shots per foot or more in optimally distributed patterns. The guns maybe loaded with deep penetrating charges for the more consolidated formations or with large entry hole charges for gravel packing unconsolidated formations. Completions are classified as retrievable or permanent depending on whether or not the guns, packer and tubing string is pulled out of the hole or not after the perforating job.

Practical considerations that favor TCP completions are, rig time savings where the long heavy gun strings would otherwise require a number of wire line runs or in highly deviated or horizontal wells where the guns must be pushed out into firing position.

Various types of TCP perforating gun firing systems have been developed and are in commercial use at the present time all of which allow the well pressure to be underbalanced or drawn below expected formation pressure prior to firing the guns.

In the drop-bar method of firing, a detonating weight bar is dropped from surface through the tubing string and production packer to a percussion detonator located in the head of the gun string. As a drop bar can not function in a highly deviated well or in the more complex completion conditions, pressure firing, either by direct application of pressure at surface through the tubing string to the TCP gun or by differential pressure applied at the surface to the tubing-casing annulus and/or bleeding off the tubing head pressure, may be used to fire the guns.

Some direct pressure firing heads are equipped with time delay fuzes or hydraulic time delay devices allowing sufficient time to bleed down the tubing pressure to achieve the desired drawdown pressure in front of the zones to be perforated before firing the guns.

Firing systems requiring a combination of actuating means such as drop bar impact and hydrostatic pressure to actuate firing systems give some measure of protection against costly and disastrous consequences of an accidental discharge out of zone or at surface. The temperature problem with explosives is exacerbated in TCP operations which require the guns be left in the well for extended periods of time before firing. Exposing the explosives to elevated temperatures for long periods has deteriorating effects often rendering them more sensitive and more dangerous to handle.

It is well known that perforating guns having percussion or stab detonators can detonate accidentally while located at the surface, while being run into the hole and while being retrieved from the hole under circumstances where the perforating gun may have failed to fire at the selected production zone. Although many different types of safety characteristics have been incorporated within commercially available perforating guns, as long as a percussion detonator is present and an apparatus is also present that might impact the percussion detonator, there is a significantly disadvantageous possibility that accidental firing may occur. Obviously, accidental firing of perforating guns can seriously damage the well and constitutes a significant hazard to persons working in the immediate vicinity. It is desirable, therefore, to provide a firing system for perforating guns which does not employ either electrical detonators which are subject to the many sources of radio frequency energy and stray electrical potentials, or, the percussion or stab detonators in mechanical devices that can initiate detonation of an explosive composition in the firing system of a perforating gun. It is also desirable to provide a perforating gun mechanism incorporating shaped charges and where an apparatus for achieving detonation of the shaped charges is of low cost and simple nature and is reliable in use.

SUMMARY OF THE INVENTION

According to the general principles of this invention, there is provided a method and mechanism for achieving, by sudden compression of a gas, adiabatically induced heat ignition or detonation of various combustible materials, including materials that inflame when ignited to develop gas pressure for doing work and materials which detonate to accomplish work explosively. These combustible materials include, but are not limited to, ignition compounds, deflagration materials, primary high explosives, secondary high explosives, combustible liquids and gases, etc. Where explosive compositions are utilized, it is a principle feature of this invention to initiate directly by adiabatically induced heat, less sensitive explosive compounds, such as those that typically comprise secondary high explosives. Further, in cases where primary high explosives are employed such as in an explosive chain of explosive compounds, including secondary high explosive compounds and explosive compounds of even less sensitive nature it is within the principles of this invention to achieve directly ignition of the primary explosive composition by means of adiabatically induced heat. Typically, a piston will be driven hydraulically to compress a gas within a cylinder, with the combustible material being exposed to the gas and thus being ignited by the high adiabatically enhanced temperature of the gas. The mass of the piston together with the hydrostatically developed force acting on the piston will ensure that the temperature of the compressed gas will remain at its peak for a sufficient length of time that ignition of the combustible material will be achieved.

According to the more specific principles of this invention for perforation of well casing during well completion activities, a perforating gun having shaped charges and detonating cords for detonation thereof is provided with a system and mechanism for adiabatically achieving detonation of a secondary high explosive composition which in turn induces detonation of the detonating cord for detonation of the shaped charges of the gun. In accordance with the preferred embodiment of the invention a secondary high explosive composition for detonation of the detonating cord is in communication with a cylinder having a gas such as air therein. The cylinder is closed by means of a piston which is secured in place by a shear pin or by any other suitable means of releasable retention. One end of the piston is exposed to fluid pressure which is present within the completion tubing string or within the casing at the level of the production zone. Typically this pressurized fluid is drilling or completion fluid or another suitable liquid which by virtue of its significant column a hydrostatic head of significant pressure at the level of the firing mechanism for the perforating gun. Where the piston is restrained by a shear pin or a ball detent latching mechanism, release of the piston may be achieved by means of a detonation bar which is dropped from the surface through the working string and which contacts the exposed end of the piston with sufficient force to shear the pin or is released by application of pressure on the tubing at the surface sufficient to shear the shear pins, the number and strength of which may be varied to actuate at the desired pressure. In the case of ball detent latching mechanisms a retainer sleeve retaining the locking balls in their locking positions can be moved directly by the drop bar or hydraulically to a ball release position.

When the piston is released the pressure of the hydrostatic head will suddenly drive the piston downwardly thus compressing the air or other gas in the chamber of the cylinder. The gas is compressed suddenly, thus causing its temperature to very rapidly increase adiabatically to a temperature at which the explosive composition to which the cylinder is exposed will detonate and induce detonation of the detonating cord. The length of the cylinder and the diameter of the pistons are designed with respect to the particular explosive composition to be detonated, such that the pressure and temperature increase of the air will reach or exceed the detonation temperature of the explosive composition. If desired, under circumstances where the pressure established by the hydrostatic head may be insufficient for achieving adiabatic detonation temperature of the gas, a pressure multiplying system may be employed. In this case a large piston is exposed to the hydrostatic head of fluid within the working string or casing. This large piston is then coupled with a smaller piston movably located within a smaller cylinder having air or another gaseous medium therein and being exposed to the explosive composition to be detonated the force of hydrostatic pressure acting on the exposed area of the large piston is transferred to the small piston and thus develops greater gas compressing force than would be developed on the small piston by hydrostatic pressure.

Although hydrostatic pressure is an acceptable medium for achieving sudden piston movement for adiabatic compression of the gas, it is not intended that this invention be limited to such. It is within the spirit and scope of this invention to incorporate any suitable means for achieving sufficiently rapid movement of the piston in compression of the gaseous medium to adiabatically raise the temperature of the gas to the ignition or detonation temperature of a combustible material such as an explosive composition, deflagration composition, combustible gas, etc. Thus, the invention is intended for use in a wide variety of circumstances other than for perforation of well casing.

It has been determined, that a reasonably low sensitivity but high order detonating medium such as RDX, when used in conjunction with the adiabatic heat device of this invention, initiates a high order detonation in RDX which becomes efficient for stimulating detonation of detonating cord or other such secondary high explosive. In accordance with this invention, spaced segments of RDX are employed with one of the segments being in immediate communication with the detonating cord or with a booster containing only secondary high explosive that is crimped to the detonating cord. The other of the explosive segment is provided with a liner and an energy focusing extremity while its opposite end, sealed with a thin easily ruptured metallic foil moisture barrier, is in communication with the air or other gas within the cylinder. It has been determined that adiabatic compression of the gas will achieve initiation of the first RDX segment and that the energy focusing design of the first RDX segment will stimulate high order detonation of the second RDX segment. It has also been demonstrated through tests that detonation of the RDX segments becomes high order before its propagation reaches the detonating cord. Hence, the detonating cord is subjected to the shock stimulation of a high order detonation. Thus, the detonating cord is subjected to high order detonation by a typically non-initiating explosive composition such as RDX. Although RDX is discussed in this specification, particularly as it relates to a detonating cord initiation system of this invention, it is to born in mind that other non-initiating secondary high explosives may be employed in similar manner to achieve high order detonation of the detonating cord or other secondary high explosive for which detonation is desired.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be comsidered limiting of its scope, for the invention may admit to other equally effective embodiments

DETAILED DESCRIPTION OF PREFERRED EMBODIMENTS

Figure 1A:
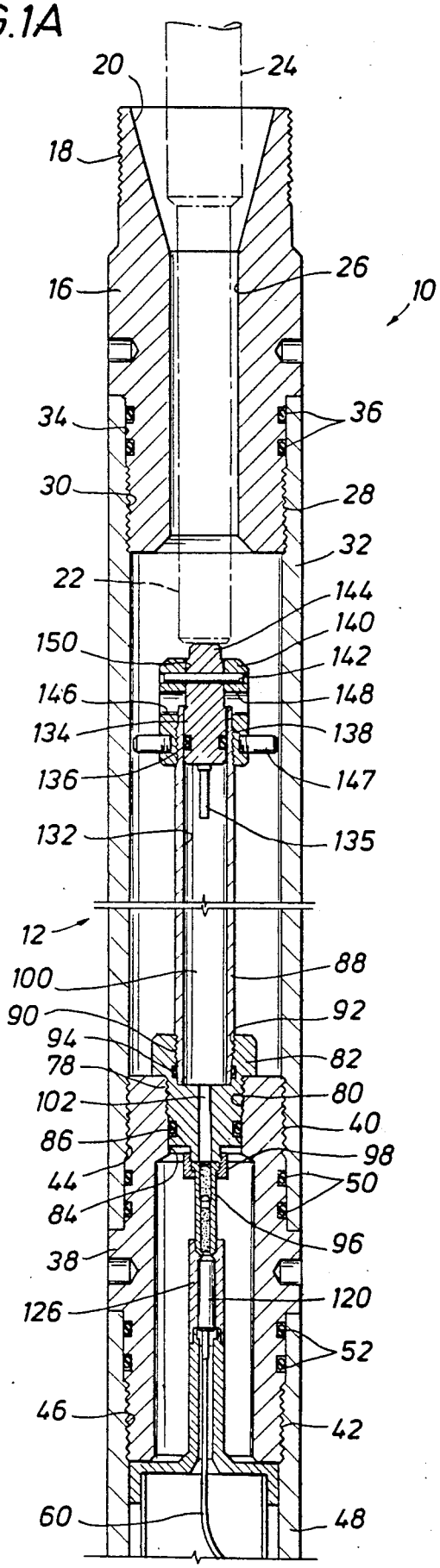
FIG. 1A is a sectional view of the upper portion of a casing perforating gun mechanism constructed in accordance with the principles of this invention and showing in broken lines a detonating bar in contact with the upper portion of the piston of the adiabatic system of this invention.
Figure 1B:
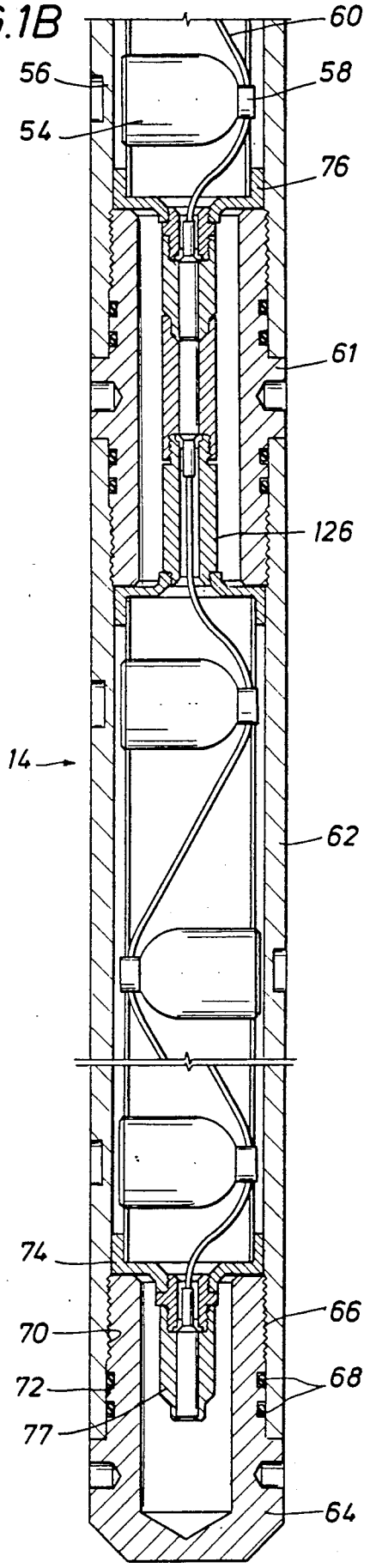
FIG. 1B is a sectional view of the lower portion of the casing perforation gun of this invention.

Referring now to the drawings and first to FIGS. 1A and 1B, a tubing conveyed perforating gun (TCP gun) incorporating an adiabatic detonating mechanism constructed in accordance with the present invention is illustrated generally at 10. The TCP gun 10 may incorporate a plurality of sub assemblies (subs) including a firing head illustrated generally at 12 which is adapted to achieve detonation of an explosive chain including detonating cord. The TCP gun also includes one or more perforating subs illustrated generally at 14 and incorporating a plurality of spaced shaped charges which are disposed for detonation by the detonating cord which extends to and is coupled with the primer of each of the shaped charges.

Referring now particularly to the firing head sub assembly 12, a coupler 16 is provided which defines an externally threaded upper extremity 18 enabling the TCP gun to be received at the lower internally threaded extremity of the well tubing string. The coupler 16 also defines a tapered internal guide surface 20 which serves to guide the lower striking end 22 of a drop bar 24 into an internal passage 26 so that the drop bar, shown in broken lines, will be accurately aligned for its striking and releasing function The passage 26 is typically described as a "no-go" passage which is of a sufficiently small dimension so as to permit only the striking portion of the drop bar to pass through the passage 26 and actuate the firing mechanism of the gun. Virtually all other objects of sufficient weight to actuate the firing mechanism of the gun will be of sufficiently large dimension that, if accidentally dropped into the working tubing string, will be of larger dimension than the no-go passage 26 and therefore will be stopped at the coupler 16. The lower end of the coupler 16 is provided with an externally threaded section 28 which is received by an internally threaded section 30 of an upper housing tube 32 which is also referred to as a debris sub. The upper end of the debris sub defines an internal sealing surface 34 which is engaged by external sealing members 36 which are supported within seal grooves formed within the coupler 16. Upper housing 32 is a "debris sub" for pipe rust, scale or other undesirable material to accumulate leaving the top of firing head 12 to perform its function. The debris sub may be sealed at its upper and lower ends by O-rings at 36 and 50 or left unsealed depending on the completion string design requirements. At times the debris sub 32 may be perforated or slotted.

The TCP gun 10 also includes an intermediate coupler 38 having upper and lower externally threaded ends 40 and 42 which respectively receive the lower internally threaded end 44 of the upper housing tube 32 and the internally threaded upper end 46 of a housing tube 48. A safety spacer, not shown which is a section of tubing 10 feet or so in length which positions the perforating gun beneath the rig floor for protection of rig personnel as the firing head detonating mechanism is being connected or disconnected is often included The housing tubes 32 and 48 are sealed with respect to the intermediate coupler by means of respective pairs of seals 50 and 52.

Within the gun housing tube 48 is provided a plurality of shaped charges, one of which is shown at 54 which is positioned at one of a plurality of reduced housing sections 56 to permit ease of housing penetration by the explosive jet that is developed when the shaped charge is detonated. Each of the shaped charges is coupled with a length of detonating cord 60. The detonating cord extends through the safety spacer and into the housing tube 48 and also along the length of gun tube housing 62 and other subsequent gun tubes such that detonation of the detonating cord will achieve consequent detonation of all of the shaped charges to thereby induce perforation of the well casing by the explosive jets of the shaped charges.

The TCP gun may be of any suitable length designed for achieving perforation of the well casing throughout the length of the casing intersecting the production zone to be produced. As shown in FIG. 1B, other gun intermediate couplers (such as that shown at 61) may be provided which permit additional perforating gun sections 62 to be assembled end to end to thereby establish a TCP gun of desired length. The lower gun housing section 62 is closed by means of a lower end cap 64 having an externally threaded lower extremity 66 and spaced circular seals 68 which are respectively received by the lower internally threaded end 70 and sealing surface 72 of the lower gun housing section 62. The lower end cap 64 also serves as a closure and retainer for the lower detonating cord connector 74 of the lower TCP gun section 62. Since the gun sections are capable of being assembled end-to-end, the detonating cord connector 74 will be substantially identical with respect to the detonating cord connector 76 shown at the lower end of the upper TCP gun section of the lower housing tube 48.

It should be born in mind that the TCP gun sections illustrated herein are of conventional nature and comprise a component part of the present invention only to the extent that the same is employed in combination with the adiabatic detonating mechanism set forth in FIG. 1A. It should also be born in mind that the adiabatic detonating mechanism of FIG. 1A is capable of being employed in various other casing perforating gun systems and therefore is not intended to be limited to the particular TCP gun system shown in FIG. 1B. Further, it is envisioned that the adiabatic detonating mechanism of FIG. 1A may be effectively employed for achieving ignition of combustible material in apparatus finding use other than for tubing conveyed perforating guns used in the completion of deep wells for the production of petroleum products.

Figure 2A:
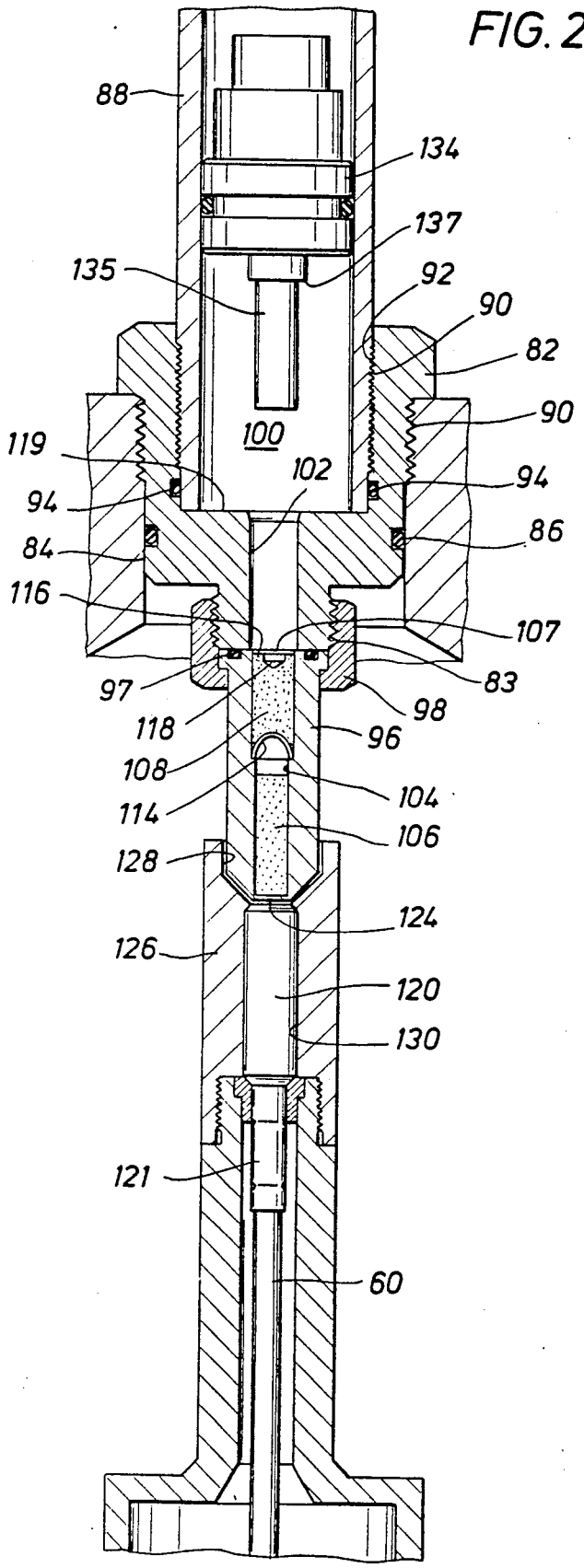
FIG. 2A is a fragmentary sectional view of the apparatus of FIG. 1A, illustrating an adiabatically initiated explosive assembly thereof in greater detail.

Referring now specifically to the adiabatic detonating mechanism of FIG. 1A, and to the more detailed illustration of FIG. 2A, the intermediate coupler 38 also forms an internally threaded upper end 78 within which is received the externally threaded intermediate portion 80 of a cylinder support 82. The cylinder support is sealed with respect to an internal sealing surface 84 of the intermediate coupler by means of a circular sealing element 86 supported within an appropriate seal groove of the cylinder support. A tubular cylinder 88 is positioned in concentric relation within the upper housing tube 32 by means of the cylinder support 82. The lower end of the cylinder 88 defines an externally threaded section 90 which is received by internal threads 92 of the cylinder support. The cylinder support is sealed with respect to the cylinder support by means of one or more circular seals 94 having sealing engagement with a sealing surface defined by the lower end of the tubular cylinder 88.

As shown in FIG. 2A the cylinder support 82 by means of the external threads 83 at its lower end may also function as a connector for the upper end of the explosive chain of the adiabatic detonating mechanism of this invention. As shown at the lower portion of FIG. 1A an explosive barrel 96 having an explosive assembly therein is shown to be connected to the lower end of the cylinder support by means of a-threaded not connector 98 and is also shown to be exposed to an internal gas chamber 100 of the cylinder by means of a firing port 102 which is a short bore also defined by the cylinder support. By threaded attachment of the explosive barrel to the lower end of the cylinder support 82 the cylinder support is not affected by detonation of the explosive 106 and 108 and is reusable. Only the explosive barrel 96 will be replaced because of the high order detonation within its explosive chamber which can deform it and which will rupture the wall 124. The detailed structure of the explosive barrel 96 and its arrangement of explosive detonating composition is illustrated in detail in FIG. 2A. As shown, the explosive barrel defines a blind bore 104 within which is seated a section 106 of a secondary high explosive composition such as RDX, HMX, HNS and PYX, which serves a component part of the detonator system for achieving detonation of detonating cord which in turn detonates the shaped charges with which the perforating gun is provided. The use of a secondary high explosive composition as the detonator of the explosive barrel provides an optimum safety feature for the adiabatic detonating mechanism of this invention. The direct adiabatic initiation of a secondary high explosive composition is less sensitive and therefore a more safe explosive as compared with the highly sensitive and more dangerous primary high explosives (such as lead azide) which are ordinarily employed in percussion caps for detonation of detonating cord in casing perforating guns.

Also located within the explosive barrel 96, and preferably in spaced relation with the section 106 of secondary high explosive composition, is a section 108 of secondary high explosive composition which may, if desired, be composed of the same secondary high explosive as the explosive segment 106. The blind bore 104 is enlarged at its upper portion and defines an internal stop shoulder against which is seated the lower end of an internally directed liner 114 which provides support for the upper explosive segment 108 and concentrates explosive energy of the explosive 108 against the lower explosive segment 106. Element 107 is a metallic bore moisture barrier for the explosive materials of the explosive barrel 96. The upper explosive segment 108 further defines an upper surface area 116 having a depression 118 formed therein to increase the surface area which is exposed to the internal chamber 100 of the tubular cylinder 88 after the metallic face 107 has ruptured. The upper explosive segment 108 is detonated adiabatically by sudden increase in the temperature of the gas within the chamber 100 and the firing port 102 in the manner described hereinbelow and concentrates energy to accelerate high order detonation of the explosive segment 106.

It has been determined through tests, though the explosive segment 106 is composed of a secondary high explosive composition such as RDX and a low order explosion would ordinarily be expected, nevertheless, a high order explosion is induced in the secondary high explosive composition by virtue of the arrangement of the explosive segments 106 and 108 within the explosive barrel 96. These tests, which were conducted with only RDX, a relatively insensitive but powerful secondary explosive commonly used in oil well charges, achieved a high order detonation in a secondary high explosive composition. The direct initiation of secondary high explosives is an important advantage of the adiabatic detonating device. Since highly sensitive and more dangerous primary high explosive compositions are not required for detonating cord detonation within the spirit and scope of this invention the resulting adiabatically initiated firing head is imminently more safe to use as compared with conventional percussion type firing heads.

In the preferred embodiment of FIG. 2A the upper end of a booster charge 120 (identical to those between other gun subs) will achieve detonation of the detonating cord. Blind bore 104 is terminated by a thin partition 124 which is readily ruptured upon detonation of the explosive segment 106. If desired, the detonating cord detonating mechanism may incorporate a booster barrel such as shown at 126 which defines a receptacle 128 within which is received the lower end of the explosive barrel 96. booster barrel 126 defines a booster chamber 130 within which is positioned booster charge 120. The lower end of the booster charge device forms a tubular connector 121 within which the detonating cord 60 is positioned and secured by crimping the connector tube. Although, for simplicity a safety spacer is not illustrated, for purposes of safety a length of tube would be coupled to the lower threaded end of coupler 38 and would be provided with a gun intercarrier head at its lower end which in turn would provide for connection with the upper end of gun housing section 48. The detonating cord 60 would then extend from the adiabatic firing head, through the safety spacer and gun intercarrier head to the first gun section in the perforating string.

It is not intended to limit the present invention to the specific explosive barrel and secondary explosive charge construction shown in FIG. 2A. For example, the upper explosive segment 108 may simply be of cylindrical form not requiring a focusing liner such as shown at 114. Additionally, for purposes of handling and ease of installation, the explosive segments 106 and 108 are preferably lined but may be lined or unlined as desired. Or, if required, the focusing configuration of the upper explosive segment may be formed in the explosive composition without the necessity of providing a liner as shown. The desired shape of the lower end of the upper explosive segment may be formed by the explosive composition itself.

Figure 2B:
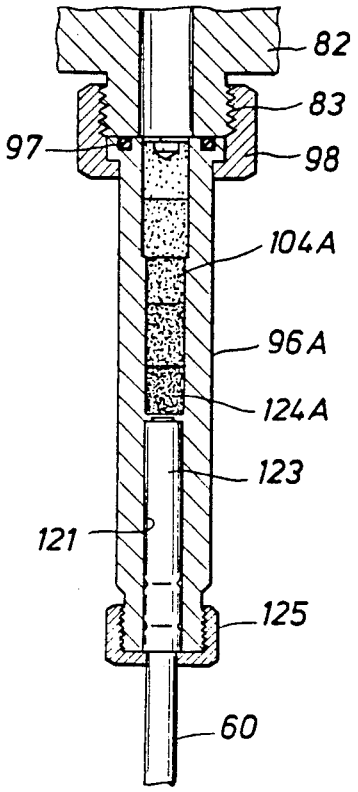
FIG. 2B is a partial sectional view of an alternative embodiment of this invention wherein successive explosive segments of increasing density from top to bottom are present to form an adiabatic heat initiated explosive detonation system.

With reference to FIG. 2B, an alternative embodiment of this invention is illustrated by the partial sectional view wherein the cylinder support 82 is provided with an externally threaded lower end 83 which receives a connecting nut 98 to retain an explosive barrel 96A in sealed assembly therewith. O-ring sealing element 97 forms a seal with the lower end of the cylinder support. The upper portion of the explosive barrel 96A forms a blind bore defining a receptacle 104A for an explosive composition. The lower portion of the explosive barrel 96A forms a blind bore defining a receptacle 104A for an explosive composition. The lower portion of the explosive barrel 96A defines a downwardly directed blind bore 121 which is separated from the upper bore 104A by a thin partition 124A that easily transmits detonation but forms a pressure barrier between the adiabatic firing device and the rest of the gun system. The blind bore 121 is open at its lower end to receive commercial booster shell 123 containing secondary high explosive crimped to an appropriate detonating cord 60. A booster retaining nut 125 threaded to the lower end of the explosive barrel 96A holds the closed end of the booster against the thin partition 124A and suspends the detonating cord 60. The alternate configuration of FIG. 2B also shows the explosive barrel with segments 105 and 106 formed of secondary high explosive but without a metallic liner 114 as in FIG. 2A. In this configuration the blind bore 104A contains explosive segments which are formed by compressing secondary high explosive powder in several separate steps with the most densely compacted portion at the lower end at the thin partition 124A and becoming progressively less compacted, toward the upper end and therefore more easily initiated where the portion of least compaction becomes exposed to the adiabatically heated gas. This technique of varying the explosive compaction is well known in the explosives industry for enhancing the deflagration to detonation transition (DDT) and is well suited to the adiabatic ignition method of this invention As mentioned above, it is a primary feature of this invention to provide a method and mechanism for adiabatically inducing detonation of an explosive composition to thus provide apparatus having characteristics of much greater safety from the standpoint of handling, running into the hole, firing and retrieval in the event the apparatus fails to fire. As also mentioned above, conventional firing mechanisms typically incorporate percussion mechanisms for achieving detonation of the explosives. These detonating mechanisms typically incorporate very sensitive and primary high explosive material such as lead azide. Such conventional devices can detonate while being handled and can also become detonated as they are run into the hole or being retrieved from the hole. In the event that a percussion detonator fails to fire, the gun assembly must be pulled from the well during which jarring or dropping the pipe may cause the released firing pin to restrike, possibly detonating the gun. Although very strict precautions are always taken to insure against malfunction, the presence of percussion caps and apparatus for striking the same significantly increases the possibility that the perforating gun can malfunction which is detrimental to workers and equipment.

According to the principles of this invention an adiabatic detonating mechanism is employed which is of simple construction and which is imminently safe during handling, during transportation and at the rig site and while being run into the hole or being retrieved from the hole. Should the apparatus fail to fire, it quickly returns to its safe condition when the adiabatically induced heat dissipates to a level below the detonation temperature of the explosive compound, such that inadvertent firing, since there need be no percussion or piercement of the initiating means, is almost impossible. As shown at the upper portion of FIG. 1A, the tubular cylinder 88 is shown to form an internal cylindrical surface 132 which receives a firing piston 134 therein which is sealed with respect to the cylindrical surface 132 by means of one or more circular piston seals 136 that are received appropriately within seal grooves or in the piston. The piston 134 is provided with a downwardly projecting rod 135, preferably a polished rod which is receivable in close fitting relation within the firing port 102 as the piston approaches the downward extent of its pressure induced travel. The rod 135 is provided with a stop shoulder 137 which contacts the upwardly facing surface 119 to limit downward travel of the piston. At the lowermost position of the rod 135 the end surface of the rod will ordinarily have a few thousandths of an inch clearance with the upper surface of the explosive such that the rod never contacts the explosive. If desired, however, the apparatus may be designed to cause the rod to contact and compress the explosive to any extent that may induce the desired explosive characteristics. The rod will function as a piston and will achieve enhanced compression of gas trapped within the bore 102 thereby enhancing the adiabatic heat to which the explosive 108 is subjected.

The tubular cylinder defines an externally threaded upper end portion 138 which provides for a threaded connection thereto of a piston retainer cap 140. The firing piston 134 and the piston retainer cap 140 define registering transverse bores which receive one or more shear pins 142 to secure the piston against movement within the cylinder until such time as the shear pin is sheared. The piston 134 also defines a striker portion 144 which projects upwardly above the level of the piston retainer cap 140. The striker portion is intended to be struck by the lower striking end 22 of the detonation bar 24. When the detonation bar is dropped through the production or working tubing string, it is guided by surface 20 through the no-go passage 26 and into contact with the striker portion 144 of the piston. The piston retainer cap 140 is also provided with a positioning device 147 which insures proper positioning of the piston retainer cap and the striker portion of the piston in centralized relation within the upper housing tube 132 so that the lower end 22 of the detonation bar will contact the striker portion of the piston.

When the shear pin 142 is sheared, the piston 134 is released and is capable of being driven downwardly by fluid pressure that is present within the upper housing tube 32. Although this fluid pressure may be provided by any one of a number of suitable sources, a most convenient source of fluid pressure is the pressure that is developed by the hydrostatic head of fluid such as drilling or completion fluid that is present in the tubing above or below a packer or present in the annulus between the casing and tubing when the perforating gun is positioned for firing at the proper formation level within the well. In most wells the column of completion fluid above the gun provides an abundance of hydrostatic pressure that is available to provide a proper hydrostatic pressure for operation of the adiabatic firing mechanism of this invention. A hydrostatic pressure acting upon the surface area prescribed by the seal 136 of the firing piston 134 will develop a pressure induced force acting upon the piston and urging the piston downwardly toward the explosive composition located below the internal gas chamber 100. This downwardly directed force is restrained by the shear pin 142 or by any other suitable means for preventing piston movement until piston movement is desired.

The gas chamber 100 of the cylinder 88 may include any gaseous composition. It has been found, however, that air at atmospheric pressure will function quite readily for adiabatic heat detonation of the explosives. To insure that the piston 134 is driven downwardly at its greatest possible velocity in response to the pressure induced force applied thereto, the piston retainer cap 140 defines large fluid inlet ports 146 and 148 which, apart from the passage 150 of the retainer cap through which the striker portion of the piston extends, will permit substantially unrestricted inlet of the hydrostatic pressure fluid medium into the gas chamber 100 above the piston. Thus, the piston will be driven downwardly at high velocity, causing substantially instantaneous compression of the gas within the chamber 100. This instantaneous increase in gas pressure adiabatically induces an instantaneous temperature elevation of the gas to a temperature exceeding the detonation temperature of the upper explosive segment 108. When this occurs the explosive segment 108 will ignite, developing a detonation of at least intermediate order which will then be applied via the focusing aspects defined by the lower inverted liner configuration of the explosive segment 108. The focused explosive energy of segment 108 will be directed against the upper end of the explosive segment 106 which, though it is composed of a secondary high explosive compound, will achieve high order detonation. The high order detonation of explosive segment 106 will induce detonation of the detonating cord 60 or the booster for the detonating cord as the case may be.

Under circumstances where the upper explosive segment 108, the explosive segment 106 or the detonating cord fails to detonate and the TCP gun fails to fire, the adiabatic detonating mechanism will very quickly return to its normal, safe condition as the adiabatically induced heat of the gas is quickly dissipated into the surrounding metal surfaces of the tubular cylinder and cylinder support and other components of the well. At the formation level the piston 134 will remain in its gas compressing position determined from the stop surface 119 provided by the cylinder support 82 at the lower end of the cylinder 88. Also, at this position of piston 134 the lower end of the compression rod will be spaced a few thousandths of an inch above the upper face of the explosive barrel 96. Thereafter, the piston can not again compress the gas and achieve adiabatic elevation of its temperature and therefore the upper explosive segment 108 can not thereafter be adiabatically detonated. Since the adiabatic detonating mechanism of this invention will very quickly return to its safe condition upon failure to fire, the working string may be quickly and safely removed from the casing and a replacement TCP gun with an adiabatic detonating mechanism may be substituted for it and quickly run into the hole for another gun firing sequence.

As the adiabatic detonating mechanism is withdrawn from the well bore, the hydrostatic pressure that will occur continuous y as the tool is moved upwardly through the liquid column in the well will allow the compressed gas within the chamber 100 to expand, thus moving the piston upwardly within the cylinder 88. As the tool reaches the surface, the gas within the chamber 100 will have expanded almost completely and its pressure will have dissipated substantially to atmospheric level. Thus, the piston 134 becomes pressure balanced during its release and detonation sequence and this pressure balanced condition is sustained thereafter even though the hydrostatic pressure to which the apparatus is subjected at the firing level dissipates as the TCP gun is removed from the well. Thus, after firing, it is not possible for the piston to again function to achieve adiabatic elevation of the temperature of the gas to the detonation temperature of the explosive composition.

Figure 3:
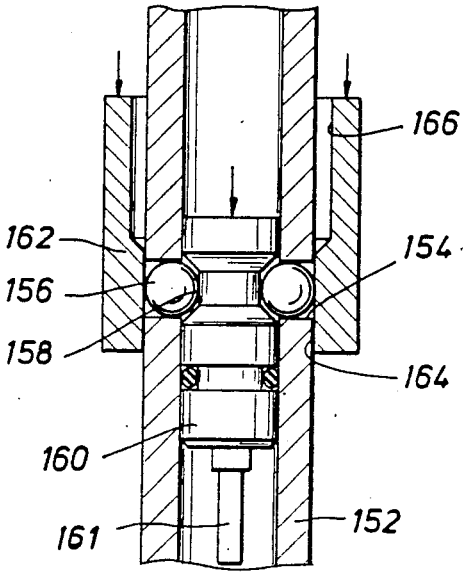
FIG. 3 is a fragmentary sectional view of a modified embodiment of this invention illustrating a ball detent piston restraint and release mechanism that may be utilized instead of the shear pin restraint and release mechanism of FIG. 1A.
Figure 4A:
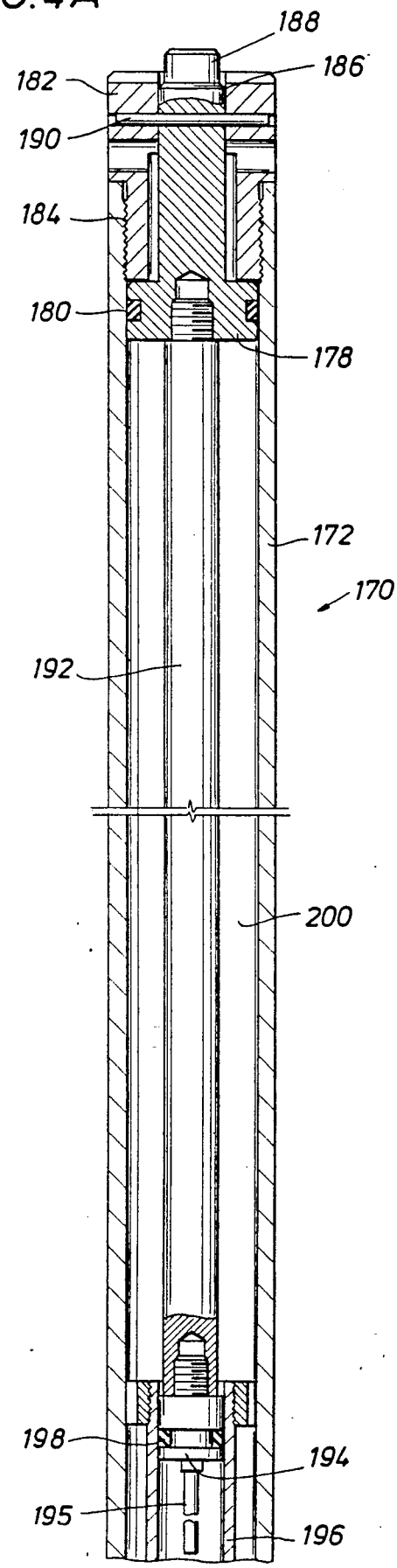
FIG. 4A is a sectional view of the upper portion of an adiabatic detonating mechanism representing an alternative embodiment of this invention.
Figure 4B:
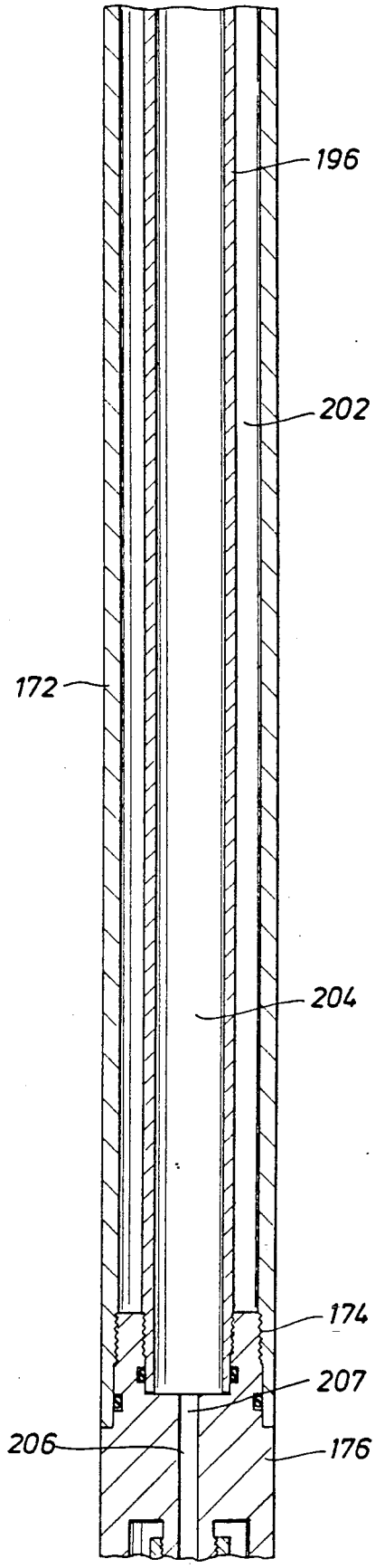
FIG. 4B is a sectional view illustrating the lower portion of the pressure or force multiplying system of FIG. 4A.

Although the firing piston 134 may be efficiently restrained by a shear pin such as shown in 142, such is not intended to limit the spirit and scope of this invention As shown in FIG. 3, a piston restraint and controlled release mechanism of the ball detent may be provided. In this case the upper end of a tubular cylinder 152 defines ball detent openings 154 which receive locking balls 156 which are receivable within a locking detent groove or slot 158 of the firing piston 160. Thus locking the piston against movement within the cylinder 152. An external ball retainer sleeve 162 surrounds the cylinder 152 and positions a locking shoulder surface 164 thereof for restraining movement of the locking balls. The sleeve 162 also defines an internally relieved area 166 which permits lateral movement of the balls 156 when the sleeve has been moved downwardly sufficiently to bring the relieved area 166 into registry with the locking ball openings 154. Downward movement of the locking sleeve 162 may be induced by means of the force applied by a detonating bar such as that shown at 24 in FIG. 1A. Alternatively, downward movement of the locking sleeve 162 may be induced hydraulically, if desired, such as by increasing the hydrostatic head of the liquid within the working string or by controlling and using differential pressure between the tubing, casing annulus above a packer and the internal tubing or "rat hole" pressure, thus causing the sleeve which will be sealed by O-rings to other structural components of the firing head to be moved downwardly as a piston. This invention, therefore, is intended to encompass any suitable structure that is capable of retaining the piston against a downwardly directed force induced by any suitable means and then releasing the piston under controlled manner for sudden gas compressing downward movement Under circumstances where the hydrostatic pressure of the liquid within the working string may not be sufficient for application of sufficient force to the piston to achieve adiabatic compression of the gas to the ignition temperature of the explosive medium. It will be desirable to provide for multiplication of the force that is developed by the hydrostatic pressure which is present. In such case, an alternative embodiment of the present invention may conveniently take the form as shown generally at 170 in FIGS. 4A and 4B. In this case an elongated tubular member 172 is provided which is internally threaded at its lower end 174 and is supported by a cylinder support member 176 in much the same manner as shown in FIGS. 1A and 1B. As piston member 178 is positioned for movement within the cylinder 172 and is sealed with respect to the cylinder by means of a circular sealing element 180. A piston retainer cap 182 is coupled to the upper end of the cylinder 172 by means of a threaded connection 184. The piston retainer cap defines a vertical passage 186 through which the upper striker portion 188 of the piston extends so that it may be struck and driven downwardly by means of a detonation bar such as that shown at 24 in FIG. 1A. The piston 178 is restrained in its uppermost position as shown in FIG. 4A by means of a shear pin 190 which extends through registering transverse bores formed in the piston and in the piston retainer cap. The detonating bar will drive the piston 178 downwardly, causing the pin 190 to shear and thus releasing the piston for downward movement under the influence of hydrostatic pressure acting upon the surface area defined by the piston seal 180.

For piston force multiplication the piston 178 is provided with a downwardly extending piston shaft 192 having a second piston 194 of smaller dimension as compared with piston 178, located at the lower end of the piston rod. The piston 194 is sealed with respect to a second tubular piston cylinder 196 by means of a circular sealing element 198. The piston chamber 200 defined by the upper cylinder 172 is in communication with the annulus 202 which is formed between the inner and outer cylinders 172 and 196. Thus a significant volume of gas within chamber 200 is available for compression by the large uppermost piston 178. As the upper piston moves downwardly, its piston shaft 192 forces the lower piston 194 downwardly within the inner cylinder 196. The gas present within the smaller piston chambers 204 and 206 defined by the smaller inner cylinder 196 will be acted upon by the force applied by hydrostatic pressure through the large piston 178 thus causing the smaller piston 194 to increase the pressure of the gas significantly above the pressure of the gas within the larger chamber 200 below the piston 178. The lower piston chamber 204 is in communication with the upper explosive segment of the explosive chain via port 206 similar to the manner shown at 102 in FIG. 2A. The net result is that a hydrostatic pressure of smaller force potential may be multiplied to thus develop a force acting upon the piston 194 to achieve sudden pressure increase of the gas within chamber 204 and later 206 to elevate its temperature adiabatically to the detonation temperature of the explosive composition.

The lower piston 194 is provided with a downwardly projecting polished rod 195 which is received in close fitting relation within the bore 206 as the piston approaches the downward limit of its travel. Though no mechanical seal is developed between the polished rod and the wells of the receptacle 206 the close fit of the rod and receptacle functions in piston-like manner to achieve even greater compression of the gas and thus even higher adiabatic heat.

In view of the forgoing, it is seen that the present invention is well adapted to attain all of the features hereinabove set forth together with other objects and features which are inherent in the apparatus itself.

While the foregoing is directed to the preferred embodiment it is recognized that the apparatus may take on various other embodiments within the spirit and scope of the invention the scope hereof is determined by the claims which follow.

What is claimed is:

1. A method for achieving direct adiabatic heat ignition of, a high explosive composition comprising:

(a) providing a hollow cylinder defining a chamber and having a gas disposed therein and having a piston movable linearly within said hollow chamber for compression of said gas;

(b) releasably retaining said piston against movement within said cylinder;

(c) entrapping a quantity of gas in a chamber, said chamber being in communication with said high explosive composition;

(d) controllably releasing said piston, thus permitting said force to sudden compression of said quantity of gas to the extent that the temperature thereof is increased adiabatically to the ignition temperature of said high explosive composition; and (e) establishing a force acting on said piston and being of sufficiently great magnitude to cause said piston, when released, to suddenly compress said gas within said chamber to the extent that the temperature of said gas is elevated adiabatically to the ignition temperature of said high explosive.

2. The method of claim 1, wherein said explosive composition is a deflagration composition.

3. The method of claim 1, wherein said explosive composition is a primary high explosive composition.

4. The method of claim 1 , wherein said explosive composition is a secondary high explosive composition.

5. The method of claim 1, wherein said explosive composition is a liquid explosive.

6. The method of claim 1, wherein said explosive composition is a deflagration charge which inflames when ignited to liberate a volume of propellant gas for accomplishing work.

7. The method of claim 1, wherein said explosive composition is a primary high explosive detonated directly by said adiabatic heat of said gas.

8. The method of claim 1, wherein said explosive composition is a secondary explosive composition that is detonated directly by said adiabatic heat of said gas.

9. A method for achieving adiabatically induced detonation of a primary high explosive composition:

(a) providing a hollow cylinder having a piston movably disposed in sealed relation therein, having a gas disposed within said cylinder and having said primary high explosive composition in communication with said gas:

(b) releasably restraining said piston against movement with said cylinder;

(c) establishing a force acting on said piston and urging said piston into said cylinder, said force being sufficiently great to cause said piston when released from said restraining to be suddenly moved within said cylinder by said force thus compressing said gas within said cylinder to the extent that the temperature of said gas is raised adiabatically to the detonation temperature of said primary high explosive composition; and (d) controllably releasing said piston for said sudden movement within said cylinder by said force.

10. The method of claim 9, including:

a secondary high explosive composition being directly initiated by said adiabatically induced temperature of said gas and inducing a high order detonation of said primary high explosive composition.

11. The method of claim 10, including achieving focusing of a component of said primary high explosive composition.

12. The method of claim 9, wherein:

(a) said gas within said cylinder is at atmospheric pressure; and (b) said cylinder having a length sufficiently great that said piston is movable a sufficient distance within said cylinder to achieve compression of said gas to an adiabatic temperature sufficiently high to achieve said detonation temperature of said primary high explosive composition.

13. The method of claim 9, wherein:

said piston defines a first end surface exposed to said gas and a second end surface exposed to a pressurized fluid developing said force.

14. The method of claim 13 wherein:

said pressurized fluid is within a well and the pressure thereof at the level of said piston is established hydrostatically at least in part.

15. A method of achieving adiabatically induced detonation of shaped explosive charges for perforation of the well casing of a well to achieve production of fluid from a production formation intersected by a well bore lined by said well casing, comprising:

(a) placing a perforating gun assembly at the production formation level within said well casing, said perforating gun assembly having a series of shaped charges interconnected by detonating cord, said perforating gun assembly further having an explosive composition and a cylinder containing a gaseous composition in communication with said explosive composition and having a piston in said cylinder disposed for gas compressing movement within said cylinder;

(b) releasably restraining said piston against gas compressing movement within said cylinder;

(c) establishing a force acting on said piston and urging said piston in a direction for compression of said gaseous composition within said cylinder, said force being sufficiently great to achieve sufficient compression of said gaseous composition to raise the temperature of said gaseous composition adiabatically to the detonation temperature of said explosive composition causing detonation of said explosive composition and detonation of said detonating cord and said shaped charges by said explosive composition; and (d) controllably releasing said piston for said gas compressing movement of said piston within said cylinder by said force.

16. The method of claim 15, wherein:

said force is established at least in part by fluid pressure developed by the hydrostatic head of fluid within said well.

17. The method of claim 15, wherein:

(a) a string of tubing forming an internal passage is located within said casing and has said perforating assembly connected thereto such that one end of said piston is exposed to said internal passage; and (b) a fluid being disposed within said tubing and developing a hydrostatic head acting on said one end of said piston and developing said force acting on said piston.

18. The method of claim 15, wherein:

(a) said force is developed by fluid pressure within said well; and (b) said piston defines a first surface area exposed to said fluid pressure and a second surface area exposed to said gas within said cylinder, said second surface area being of less dimension than said first surface area thus achieving compression of said gas to a pressure level above the level of said fluid pressure.

19. The method of claim 15, wherein:

said explosive composition includes first and second segments of secondary high explosive composition said first segment of said secondary high explosive composition being initiated by said adiabatically induced temperature of said gas, and inducing high order detonation of said second segment of said secondary high explosive.

20. The method of claim 15, including:

achieving focusing of said first segment of secondary high explosive composition toward said second segment of secondary high explosive composition thus inducing high order detonation of said second segment of secondary high explosive composition.

21. The method of claim 15, wherein:

said explosive composition is compacted in layers of increasing density, the layer of least density being initiated by adiabatic heat of said gas and developing a detonation wave that propagates through said layers to the layer of greatest density, said detonation wave propagation initiating at deflagration velocity and transitioning to high order detonation velocity between said layers of least and greatest density.

22. Adiabatic heat initiation apparatus for, a high explosive composition comprising:

(a) a combustion barrel forming a combustion chamber said combustion barrel forming a rod bore;

(b) a quantity of said high explosive composition being disposed within said combustion chamber;

(c) a cylinder forming a piston chamber in communication with said combustion chamber and having a gas disposed therein;

(d) a piston disposed within said cylinder for gas compressing movement therein;

(e) means developing a force acting on said piston and urging said piston in a gas compressing direction, said force being sufficiently great to induce sudden gas compressioning movement of said piston to raise the temperature of said gas adiabatically to the ignition temperature of said high explosive composition for initiation of combustion thereof; and (f) means releasably restraining said piston against said gas compressing movement and being selectively controllable for release of said piston.

23. The adiabatic heat initiation apparatus as recited in claim 22, wherein (a) said combustion barrel forms a rod bore of less cross-sectional dimension as compared with the cross-sectional dimension of said cylinder; and (b) said piston has a compression rod extending therefrom and positioned to be received in gas compressing manner within said rod bore for enhanced compression of gas therein.

24. The adiabatic heat initiation apparatus as recited in claim 23, wherein:

said compression rod has a length such that at maximum gas compressing movement of said piston the end of said compression rod will be in closely spaced relation with said high explosive composition.

25. The adiabatic heat initiation apparatus as recited in claim 24, wherein:

said compression rod has a length such that at maximum gas compressing movement of said piston the end of said compression rod will be in compressing engagement with said high explosive composition.

26. The adiabatic heat initiation apparatus as recited in claim 22, wherein:

said combustible composition is a high explosive composition.

27. The adiabatic heat initiation apparatus as recited in claim 22, wherein:

said combustible composition is a secondary high explosive composition.

28. The adiabatic heat initiation apparatus as recited in claim 27, wherein said high explosive composition is a secondary high explosive composition.

29. The adiabatic heat initiation apparatus as recited in claim 22, wherein said combustible composition comprises:

(a) first and second segments of high explosive composition being disposed in spaced relation within said combustion chamber; and (b) means focusing said first segment of high explosive composition toward said second segment of high explosive composition and achieving high order detonation of said second segment of high explosive composition.

30. The adiabatic heat initiation apparatus as recited in claim 22, wherein said high explosive composition comprises:

a plurality of layers of high explosive composition being disposed within said combustion chamber and varying progressively in density from a least dense layer exposed to said gas within cylinder to a layer of greatest density remove from said cylinder.

31. The adiabatic heat initiation apparatus as recited in claim 30, wherein said high explosive composition is a secondary high explosive composition and is induced high order at a location between said layer of least density and said layer of greatest density.

32. The adiabatic heat initiation apparatus as recited in claim 22, wherein said means releasably restraining said piston comprises:

at least one shear pin releasably connecting said piston in immovable relation with said cylinder.

33. The adiabatic heat initiation apparatus as recited in claim 22, wherein said means releasably restraining said piston comprises:

(a) a plurality of locking detents being positionable at locking positions establishing releasable locked interengagement between said piston and said cylinder and release positions permitting relative movement of said piston and said cylinder; and (b) a linearly movable locking sleeve normally retaining said locking detents at said locking positions thereof and being selectively movable to a position permitting movement of said locking detents to said release positions thereof.

34. In perforating guns having shaped charges for explosive perforations of well casing, liners, and the formation surrounding the well casing of wells, for completion of said wells and having detonating cord for detonation of said shaped charges, the improvement comprising:

(a) an explosive composition disposed in detonating relation with said detonating cord and having an initiating temperature;

(b) a gas chamber having a gas therein, said gas being in communication with said explosive composition; and (c) means utilizing the energy of pressurized fluid within said well for sudden compression of said gas to increase the temperature thereof adiabatically to said initiation temperature of said explosive composition.

35. The improvement of claim 34, wherein said explosive composition is disposed within an explosive initiating device which comprises:

(a) an explosive barrel forming an explosive chamber, said explosive composition being disposed within said explosive chamber, said detonating cord being positioned for detonation by said explosive composition;

(b) a cylinder forming a gas chamber having said gas disposed therein, said gas chamber being in communication with said explosive chamber:

(c) a piston being disposed for movement within said cylinder under the influence of force developed thereon by fluid pressure within said well; and (d) locking means restraining said movement of said piston and being selectively actuatable to a release condition whereby said piston is movable by said fluid pressure to compress said gas within said gas chamber and increase the temperature of said gas adiabatically to the initiation temperature of said explosive composition.

36. The improvement of claim 35 wherein said explosive composition is a secondary explosive composition which is directly initiated by said adiabatically increased temperature of said gas.

37. The improvement of claim 35, wherein said explosive composition comprises:

at least two spaced segments of a high explosive composition at least one of which is a secondary explosive composition being in communication with said gas.

38. The improvement of claim 37, including:

means focusing said one of said segments of high explosive composition toward the other of said segments of high explosive composition, said focusing means developing high order detonation of said explosive composition within said explosive barrel for initiation of said detonating cord.

39. The improvement of claim 35, wherein:

said explosive composition within said explosive chamber is disposed in layers of progressively varying density with the layer of least density in communication with said gas and the layer of greatest density extending toward said detonating cord.

40. The improvement of claim 35, wherein said locking means comprises:

shear retainer means releasably retaining said piston against gas compressing movement within said cylinder, said shear retainer means shearing upon application of predetermined force to said piston by said fluid pressure thus releasing said piston.

41. The improvement of claim 40, wherein:

(a) said explosive barrel defines a compression rod receptacle being in communication with said explosive composition and being of less dimension than said piston; and (b) a compression rod projecting from said piston and being received within said compression rod receptacle, said compression rod upon gas compressing movement of said piston entering said compression rod receptacle and increasing the pressure and adiabatic heat of said gas.

42. The improvement of claim 41, wherein:

said compression rod, upon gas compressing movement of said piston to the full extent thereof, having clearance with said explosive composition.

43. The improvement of claim 42, wherein:

said compression rod, upon gas compresses movement of said piston to the full extent thereof, having compressive engagement with said explosive composition.

* * * * *